United States Patent [19]

Kaustrater

[11] Patent Number: 4,593,600

[45] Date of Patent: Jun. 10, 1986

[54] DEVICE FOR FEEDING SHELL AMMUNITION WITHIN AN ARMORED VEHICLE

[75] Inventor: Gert Kaustrater, Augsburg, Fed. Rep. of Germany

[73] Assignee: KUKA Wehrtechnik GmbH, Fed. Rep. of Germany

[21] Appl. No.: 539,378

[22] Filed: Oct. 5, 1983

[30] Foreign Application Priority Data

Oct. 12, 1982 [DE] Fed. Rep. of Germany ..... 3237729

[51] Int. Cl.[4] ..... F41F 9/02

[52] U.S. Cl. ..... 89/33.1; 89/36.13; 89/46

[58] Field of Search ..... 89/1.801, 1.802, 1.805, 89/33.1, 36 B, 45, 46, 33.02

[56] References Cited

U.S. PATENT DOCUMENTS

| | | | |
|---|---|---|---|
| 2,951,422 | 9/1960 | Bobkowski | 89/33.1 |
| 3,045,553 | 7/1962 | Mosle | 89/45 |
| 3,683,743 | 8/1972 | Stoner | 89/33.02 |
| 4,092,901 | 6/1978 | Gustavsson et al. | 89/46 |
| 4,381,693 | 5/1983 | Dumez | 89/36 K |

FOREIGN PATENT DOCUMENTS

| | | | |
|---|---|---|---|
| 2016373 | 11/1970 | Fed. Rep. of Germany . | |
| 2149954 | 4/1973 | Fed. Rep. of Germany . | |
| 3022410 | 12/1981 | Fed. Rep. of Germany | 89/46 |
| 2067899 | 7/1971 | France . | |
| 2288292 | 10/1974 | France . | |
| 2301798 | 2/1975 | France . | |
| 554619 | 7/1943 | United Kingdom . | |

*Primary Examiner*—Stephen C. Bentley
*Attorney, Agent, or Firm*—Barnes & Thornburg

[57] ABSTRACT

On a device for feeding shell ammunition within an armored vehicle (1) featuring a rotatable turret (3) with a shield (4) rising on it as a bearing for a weapon carrier (8) which carries sideways its shell magazine fashioned as a container (11, 11') there is provided, inside a vehicle (1), a horizontally extending container switching chute (12) within which there are located two container reloading stations (13, 13') which are so arranged, below openings (14, 14') in the ceiling armor (5), that they will be in alignment with two container shoes (15, 15') fitted to both sides of the weapon support (8), in an angular position of the turret (3) coinciding with an index position and at an elevation angle coinciding with an index position. The space between container reloading station and container shoe is being bridged by transport facilities (16). Two containers (11, 11') can be arranged on the two sides of the weapon support (8) in a detachably lockable and ejectable manner.

13 Claims, 3 Drawing Figures

DEVICE FOR FEEDING SHELL AMMUNITION WITHIN AN ARMORED VEHICLE

Figure 1:
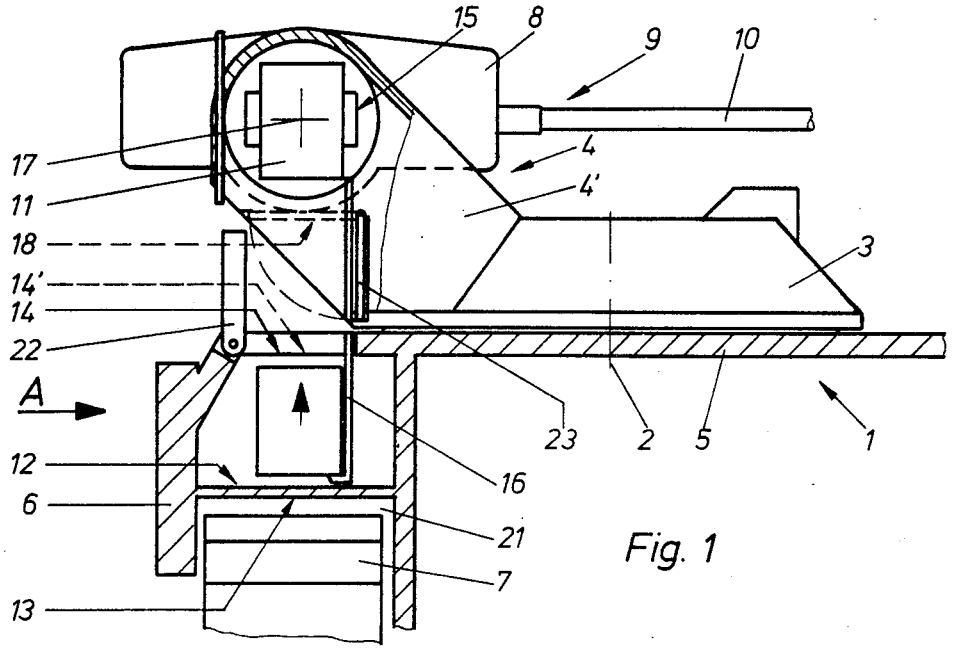

The invention concerns a device for feeding shell ammunition within an armored vehicle featuring a turnable turret on which rises a shield serving as bearing for a weapon support which carries sideways its shell magazine fashioned as a container, with a horizontally extending container switching chute being provided within the vehicle, within which chute a container reloading station is located which underneath an opening in the ceiling armor is so arranged that in an indexed turning position of the turret and at an indexed elevation angle it will be aligned with the container shoe fitted to the weapon support, the distance from the reloading station being bridged by a transport device.

A device of this design is previously known (German patent disclosure No. 30,22,410) where the container which has been fired empty, upon release, can be lowered with the aid of the transport facility, through the opening, into the container reloading station, where the container can then be shifted out of the container reloading station, through the container switching chute, with the aid of a following, filled replenishment container taking the place of the container which has been fired empty.

While the containers used are of a reloadable and therefore reusable type, it may be too time-consuming and laborious in combat to move the containers fired empty back into the container reloading station, and thus into the switching chute. Also, an ammunition change, for instance from piercing AP ammunition to highly explosive HE ammunition, would be too laborious, since it would always require a container change.

The problem underlying the invention is therefore to provide a device of the initially mentioned design which enables an especially quick container change, which at the weapon support and thus at the breech of the weapon makes twice the number of shells available, and which lastly permits a change between two shell types to be fired without requiring a container change.

This problem is inventionally solved in that within the container switching chute there are two container reloading stations located underneath openings in the ceiling armor, which reloading stations are in alignment with two container shoes fitted on both sides of the weapon support, and in that two containers can be arranged on the two sides of the weapon support in a releasably locked and ejectable fashion.

Since two containers with facultatively different shell types are available at the weapon, a simple changeover operation at the shell loader makes it possible to selectively fire ammunition from one or the other container without requiring a magazine change, which is advantageous especially when a change of ammunition type is required. Naturally, the two containers may as well contain like ammunition. At any rate, twice the number of rounds is inventionally available at the weapon itself.

A particular advantage is constituted by the inventional ejectability of the containers, making their return to the reloading station unnecessary but not no longer possible. However, not returning the emptied container to the reloading station enables an especially quick container change, since in this case the emptied containers, upon unlocking from the weapon, are simply ejected sideways, for instance through spring action, and make room for the filled containers which through the transport device are raised from the reloading station. It goes without saying that such one-way traffic from the reloading station to the weapon support enables a quicker feeding of filled containers.

According to the preferred embodiment, the shield is of a dual design and holds the weapon support in between; the two containers can be locked to the weapon support in the area of the horizontal axis of elevation, and the two shield halves feature on their undersides closable openings for introducing and, as the case may be, returning the containers and, on their outsides, closable openings for ejecting the emptied containers. This design enables the container to remain in the weapon support area protected by the dual shield also in various positions of elevations of the weapon.

The closable openings suitably feature outwardly opening hatches which in their opened position do not require space within the shield.

In addition, it has been found advantageous to arrange the horizontally extending container switching chute in the area above a track or wheel well and essentially parallel with it. It goes without saying that the two openings provided in the ceiling armor, above the switching chute, must be spaced from each other a distance equaling the spacing of the transport devices extending to the weapon support and/or the shield. Thus, the turret only needs to be moved in that angular position in which the container shoes fitted to the weapon support will be aligned with the openings, which is the case at simultaneous zero elevation, so that filled containers can be reloaded from the switching chute.

The invention and its favorable designs will be more fully explained hereafter with the aid of an embodiment illustrated in the drawing.

Figure 2:
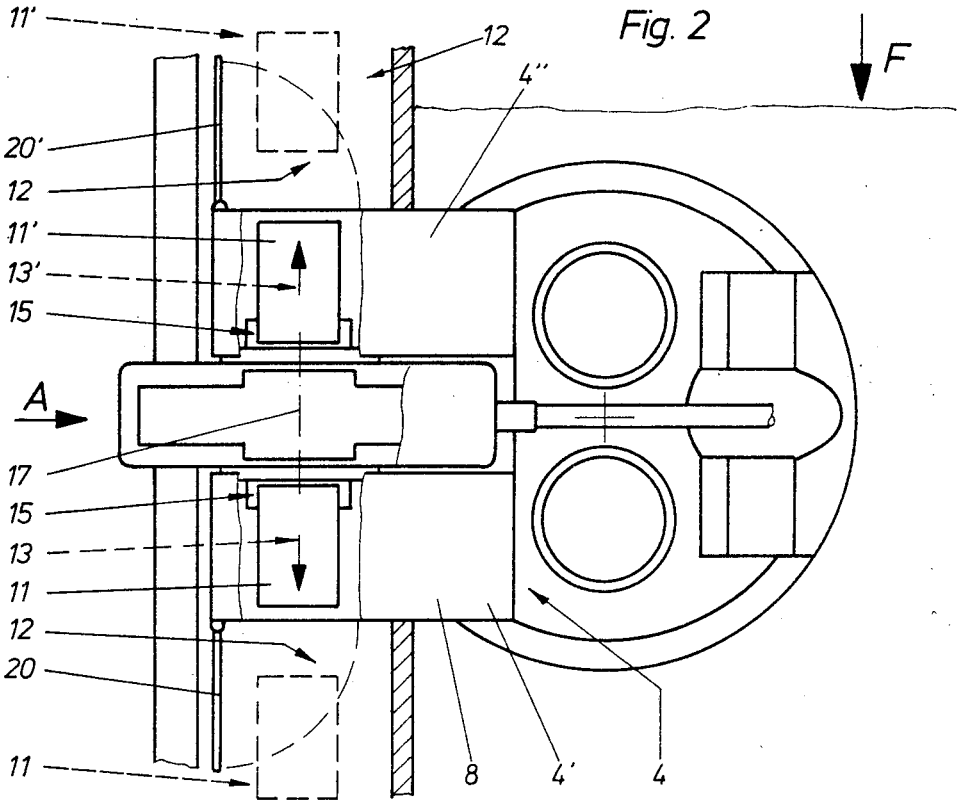
Figure 3:
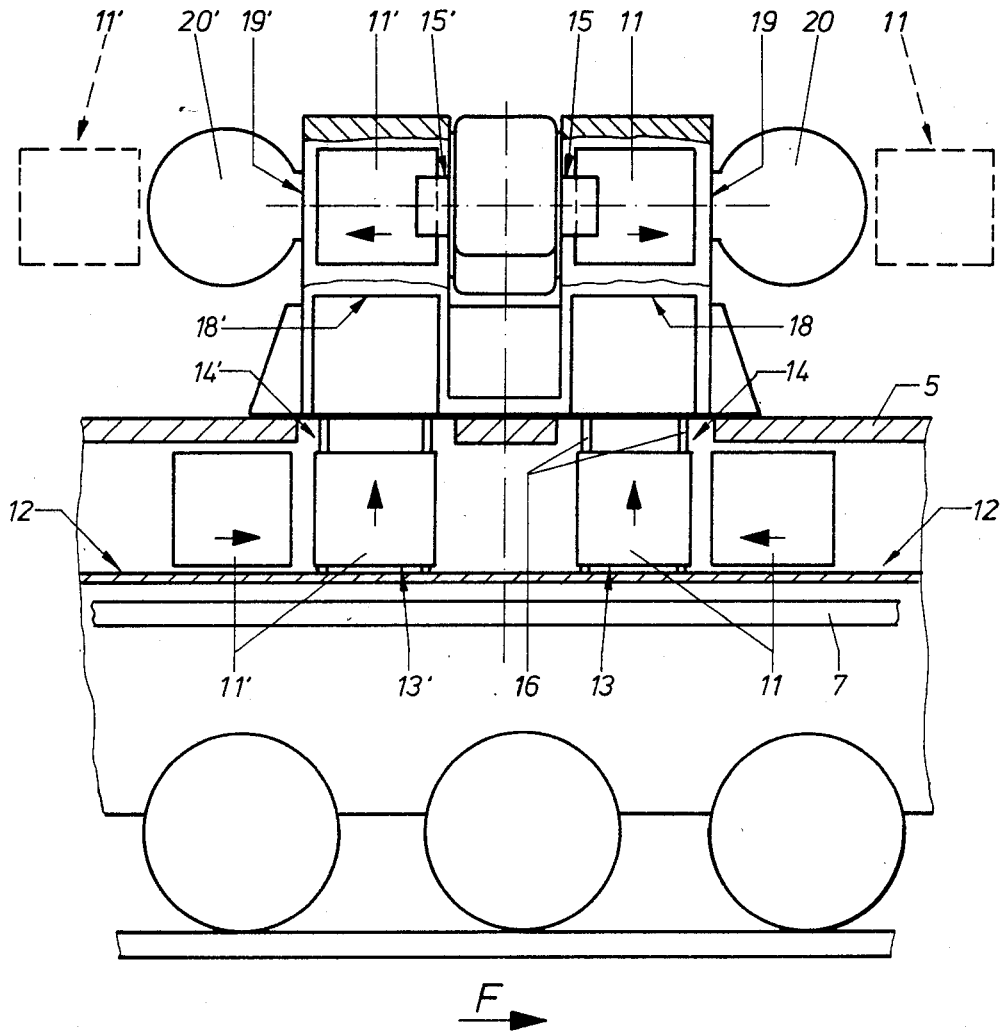

FIG. 1 shows a section of a front elevation of a track type armored vehicle, partly in section and with the turret in transverse position, equipped with a device relative to the invention;

FIG. 2, a plan view of the device relative to FIG. 1, also as a partial view;

FIG. 3, a side elevation of the device relative to FIGS. 1 and 2, viewed in the direction of arrow A.

On the illustrated embodiment, the inventional device for the feeding of shell ammunition is contained on an armored vehicle 1 with an armored turret 3 rotating around a vertical axis 2 and on which rises a shield 4. For the sake of clarity, only parts of the ceiling armor 5, side armor 6 and a track 7 are illustrated of the armored vehicle 1.

The shield 4 serves as a bearing for the weapon support 8 which carries a weapon 9 of which only the barrel 10 is visible. As follows from FIG. 1, the weapon support 8 carries its shell magazine, which is fashioned as a container 11, sideways. Provided within the armored vehicle 1 is a horizontally extending container switching chute 12 within which there is located a container reloading station 13 arranged in such a way underneath an opening 14 in the ceiling armor 5 that it will be in alignment with the container shoe 15 fitted to the weapon support when the turret 3 has rotated into an index position while the weapon 9 is elevated to an index position. The distance between the container reloading station 13 and the container shoe 15 is being bridged by transport facilities 16, for instance by an elevator.

Inventionally, there are now two container reloading stations 13, 13' located within the container switching chute 12 and below the openings 14, 14' in the ceiling armor 5, which openings are in alignment with two container shoes 15, 15' located on the two sides of the weapon support 8, with two containers 11, 11' being permitted to be arranged on the two sides of the weapon support 8 in a detachably lockable and ejectable fashion.

On the illustrated embodiment, the shield 4 is a dual design and features thus two shield halves 4' and 4" holding the weapon support 8 between them. The two containers 11, 11' can be locked in the area of horizontal axis of elevation 17 on the weapon support 8. The two shield halves 4', 4" feature on their undersides closable openings 18, 18' for receiving and, as the case may be, returning the containers 11, 11' and, on their outsides, closable openings 19, 19' for ejection of the emptied containers 11, 11'. The emptied, ejected containers 11, 11' are illustrated in FIGS. 2 and 3 by broken lines. The closable openings 19, 19' feature outwardly opening hatches 20, 20'.

On the illustrated, preferred embodiment, the horizontally extending container switching chute 12 is arranged in the area above a track well 21 and essentially parallel with it. It goes without saying that in the ceiling armor 5, above the switching chute 12, there are two openings 14, 14' provided. In the respective index positions, these openings 14, 14' are in alignment with the container shoes 15, 15', provided the turret 3 and the elevation angle of the weapon 9 are at the respective index positions. On the illustrated embodiment, the index position relating to the angle of rotation of the turret 3 is a position transverse to the longitudinal axis of the armored vehicle 1 and/or its direction of travel according to arrow F (FIGS. 2 and 3), and the index position relating to the angle of elevation of the weapon 9 is the horizontal zero-elevation of the weapon 9 and weapon support 8. It goes without saying that the closures of the opening 14, 14' and/or 18, 18' must be opened for reloading, for intance swinging two hatches 22 up and two hatches 23 down, of which in FIG. 1 only the front one is indicated. Various design possibilities exist for the elevator 16, which are previously known and are not the object of the present invention.

It is pointed out that above each of the two track wells a container switching chute 12 with two openings 14, 14' provided above these in the ceiling armor 5 may be provided, in a fashion such that twice the amount of ammunition can be taken aboard. For container change, the index position of the turret 3 angle of rotation can in this case be so selected that the turret permits arrangement transverse to the armored vehicle 1 either toward the one or the other side. There are thus two index positions, spaced 180° from each other, in which the container shoes 15, 15' will be in alignment with the reloading 13, 13' of the container switching chute, either above the one or the other track well 21.

The various container stations 13, 13' may be provided for different types of ammunition so that, e.g., only AP ammunition (anti-person ammunition) will be reloaded from the container reloading station 13, whereas only HE ammunition (high-explosive ammunition) will be reloaded from the container reloading position 13'.

The hatches 20, 20' opening outwardly on the two shield halves 4', 4" are preferably of a circular design and have a diameter that is sufficiently large for enabling a container 11, 11' ejection in any position of elevation of the barrel 10 of the weapon 9.

I claim:

1. A device for feeding ammunition shells within an armored vehicle to a shell-firing weapon in said armored vehicle, the device comprising a single horizontally-extending container switching chute for conducting shell containers in opposite directions along a path therethrough, a turret comprising first and second shield halves, means for rotatably supporting the turret on the armored vehicle for rotation to an index position, a shield situated above the turret, weapon support means for changing the angle of elevation of the shell-firing weapon around a substantially horizontal axis of elevation, the weapon support means being mounted on the shield halves which cooperate to enclose the weapon support means and the substantially horizontal axis of elevation therebetween, the weapon support means including a pair of separate container shoe means for detachably locking each shell container to the weapon support means and conducting shells from a shell container to the shell-firing weapon, the pair of container shoe means being spaced-apart to lie in straddling relation to the shell-firing weapon thus defining a pair of spaced-apart shell container emptying sites, first bridge means for transporting a shell container from said single horizontally-extending container switching chute to one of the container shoe means when the turret is rotated to the index position and the angle of elevation of the shell-firing weapon corresponds to the index position, the first bridge means intersecting said single horizontally-extending container switching chute to define a first container reloading station for receiving shell containers transported through said single horizontally-extending container switching chute in a first direction, second bridge means for transporting a shell container from said single horizontally-extending container switching chute to the other of the container shoe means when the turret is rotated to the index position and the angle of elevation of the shell-firing weapon corresponds to the index position, the second bridge means intersecting said single horizontally-extending container switching chute to define a second container reloading station for receiving shell container transported through said single horizontally-extending container switching chute in a second direction opposite to said first direction, said second container reloading station being separated in spaced-apart relation to said first container reloading station, whereby a first shell container storing a first type or shell is movable to said one container shoe means for loading into the shell-firing weapon via said single horizontally-extending container switching chute and the first bridge means and a second shell container storing one of the first type of shell and another type of shell is movable to said other container shoe means for loading into the shell-firing weapon via said horizontally-extending container switching chute and the second bridge means so that said shell-firing weapon is able to fire selectively a shell from either of the first and second shell containers.

2. The device of claim 1, wherein the armored vehicle further comprises one of a pair of spaced-apart track wells and a pair of spaced-apart wheel wells, and the horizontally-extending container switching chute overlies said one of a pair of spaced-apart track wells and a pair of spaced-apart wheel wells in substantially spaced-apart parallel relation.

3. The device of claim 1, wherein the first shield half intersects the first bridge means and is formed to include an opening at the point of intersection for passing shell containers therethrough and the second shell half intersects the second bridge means and is formed to include an opening at the point of intersection for passing shell containers therethrough.

4. The device of claim 3, further comprising a pair of separate closure means for selectively closing each of the first and second shield half openings.

5. The device of claim 1, wherein the first and second shield halves are each formed to include an ejection opening for the ejection of emptied shell containers from the container shoe means.

6. The device of claim 5, further comprising a pair of separate closure means for selectively closing each of the first and second shield half ejection openings.

7. The device of claim 6, wherein each closure means includes an outwardly opening hatch.

8. The device of claim 1, wherein the pair of container shoe means is arranged in the area of the horizontal axis of elevation of said shell-firing weapon within the shield halves.

9. The device of claim 1, wherein the first bridge means is arranged at least partially within the first shield half and the second bridge means at least partially within the second shield half, both shield halves featuring on their undersides closable opening means for passing shell containers therethrough.

10. The device of claim 9, further comprising a pair of separate closure means for selectively closing each of the first and second shield half openings.

11. A device for feeding ammunition shells within an armored vehicle formed to include a horizontally-extending container switching chute for conducting shell containers along a path, the device comprising weapon means for firing a shell, a turret, means for rotatably supporting the turret on the armored vehicle for rotation to an index position, a shield situated above the turret, weapon support means for changing the angle of elevation of the weapon means, the weapon support means being mounted on the shield, the weapon support means including a pair of separate container shoe means for conducting shells from a shell container to the weapon means, the pair of container shoe means being spaced-apart to lie in straddling relation to the weapon means thus defining a pair of spaced-apart shell container emptying sites, first bridge means for transporting a shell container from the horizontally-extending container switching chute to one of the container shoe means when the turret is rotated to the index position and the angle of elevation of the weapon means corresponds to the index position, the first brige means intersecting the container switching chute to define a first container reloading station, second brige means for transporting a shell container from the horizontally-extending container switching chute to the other of the container shoe means when the turret is rotated to the index position and the angle of elevation of the weapon means corresponds to the index position, the second bridge means intersecting the container switching chute to define a second container reloading station separated in spaced-apart relation to the first container reloading station, whereby a first shell container storing a first type of shell is movable to said one container shoe means for loading into the weapon means via the container switching chute and the first bridge means and a second shell container storing one of the first type of shell and another type of shell is movable to said other container shoe means for loading into the weapon means via the container switching chute and the second bridge means so that the weapon means is able to fire selectively a shell from either of the first and second shell containers, wherein the armored vehicle further comprises one of a track and wheel well, and the horizontally-extending container switching chute overlies the one of the track and the wheel well in substantially spaced-apart parallel relation.

12. A device for feeding ammunition shells in an armored vehicle including a weapon for firing a shell, the device comprising a horizontally-extending container switching chute for conducting shell containers in opposite directions along a path, said container switching chute providing separate first and second container reloading stations situated in spaced-apart relation along said path, a turret, means for rotatably supporting the turret on the armored vehicle for rotation to an index position, a shield above the turret, weapon support means for changing the angle of elevation of the weapon, the weapon support means being mounted on the shield, the weapon support means including a pair of separate container shoe means for conducting shells from a shell container to the weapon, the pair of container shoe means being spaced apart to lie in straddling relation to the weapon, thus defining a pair of spaced apart shell container emptying sites, first bridge means for transporting a first series of shell containers conducted through said container switching chute in a first direction from said first container reloading station to one of the shoe means when the turret is rotated to the index position and the angle of elevation of the weapon corresponds to the index position, second bridge means for transporting a second series of shell containers conducted through said container switching chute in a second direction opposite said first direction from said second container reloading station to the other of the container shoe means so that said weapon is able to fire selectively a shell from a container in either of said first and second series of shell containers.

13. A device for feeding ammunition shells in an armored vehicle to a shell-firing weapon in said armored vehicle, the device comprising a single horizontally-extending container switching chute for conducting shell containers in different directions along a path therethrough, said container switching chute providing separate first and second container reloading stations situated in spaced-apart relation in said path, a turret, means for rotatably supporting said turret on said armored vehicle for rotation to an index position, a shield above said turret, weapon support means for changing the angle of elevation of said shell-firing weapon, said weapon support means being mounted on said shield, said weapon support means including a pair of separate container shoe means for conducting shells from a shell container to said shell-firing weapon, said pair of container shoe means being spaced apart to lie in straddling relation to said shell-firing weapon, thus defining a pair of spaced-apart shell container emptying sites, first bridge means for transporting a first series of shell containers conducted through said container switching chute in a first direction from said first container reloading station to one of said shoe means when said turret is rotated to said index position and said angle of elevation of said shell-firing weapon corresponds to said index position, second bridge means for transporting a second series of shell containers conducted through said container switching chute in a second direction different than said first direction from said second container reloading station to the other of said container shoe means so that said weapon is able to fire selectively a shell from a shell container affiliated with either of said first and second series of shell containers.

* * * * *